United States Patent [19]

Terakawa

[11] 4,349,819

[45] Sep. 14, 1982

[54] SYSTEM FOR DRIVING A PLASMA DISPLAY PANEL DEVICE

[75] Inventor: Toshiaki Terakawa, Machida, Japan

[73] Assignee: Fujitsu Limited, Kawasaki, Japan

[21] Appl. No.: 135,181

[22] Filed: Mar. 28, 1980

[30] Foreign Application Priority Data

Mar. 29, 1979 [JP] Japan ..... 54-37398

[51] Int. Cl.[3] ..... G09G 3/28

[52] U.S. Cl. ..... 340/812; 340/713; 340/777

[58] Field of Search ..... 340/812, 813, 805, 777, 340/776, 713, 714

[56] References Cited

U.S. PATENT DOCUMENTS 3,824,580 7/1974 Bringol ..... 340/776

4,109,180 8/1978 Ogle et al. ..... 340/813

*Primary Examiner*—Marshall M. Curtis

*Attorney, Agent, or Firm*—Staas & Halsey

[57] ABSTRACT

In a system for driving a plasma display panel, predetermined different values of the discharge voltage are selected corresponding to predetermined different ranges of the ratio of the number of discharging spots to the number of the entire spots of said plasma display panel.

6 Claims, 6 Drawing Figures

SYSTEM FOR DRIVING A PLASMA DISPLAY PANEL DEVICE

BACKGROUND OF THE INVENTION

1. Field of the Invention

The present invention relates to a system for driving a plasma display panel (PDP) device, and more particularly to the supply of the discharge voltage to the electrodes of the plasma display panel.

2. Description of the Prior Art

In general, a plasma display panel of an AC type has a first and a second plurality of electrodes which are disposed to traverse each other in the form of a matrix and are covered with dielectric layers. A discharge is formed in a confined discharge gas between the electrodes at a cross point of one of the first electrodes and one of the second electrodes.

A prior art driving circuit of a plasma display panel is illustrated in FIG. 1, and a time chart of the operation of the device of FIG. 1 is illustrated in FIG. 2.

X-directional electrodes 21, 22,–, 2*n* and Y-directional electrodes 31, 32,–, 3*n* of a plasma display panel 1 are supplied with voltage sustaining voltages $V_S$ and information writing-in voltages $V_W$, $-V_W$ by a drive circuit 4 which comprises a switching network with transistors and diodes. Dischargeable spots are formed by cross points between the X-directional electrodes 21, 22,–, 2*n* and the Y-directional electrodes 31, 32,–, 3*n*.

If a signal x(al) is applied during the period $t_1$ to $t_2$, and a signal x(bl) is applied during the period $t_2$ to $t_3$, an output voltage V(xl) is supplied to the electrode 21, during the period $t_1$ to $t_2$, as illustrated in (1), (2) and (3) of FIG. 2.

If a signal y(al) is applied during the period $t_4$ to $t_5$, and a signal y(bl) is applied during the period $t_5$ to $t_6$, an output voltage V(yl) is supplied to the electrode 31 during the period $t_4$ to $t_5$, as illustrated in (5) and (6) of FIG. 2 and (2) of FIG. 3.

Sequences of pairs of the signals x(al) and x(bl) and pairs of the signals y(al) and y(bl) are applied alternatively. Accordingly, sequences of the signals V(xl) and the signals V(yl) are generated alternatively. As a result, to the spot formed by the cross point of the electode 21 and the electrode 31, a sequence of the voltage V(xy) represented by the wave form (4) of FIG. 3 is supplied. The height of the wave V(xy) is equal to the discharge sustaining voltage $V_s$.

The base voltages of the transistors 451 through 45*n* are controlled when the information writing-in voltages $V_W$, $-V_W$ are applied.

A writing-in of an information is effected by applying writing in voltages $V_W$, $-V_W$ to the electrodes 21 and 31, respectively, as illustrated in (4) of FIG. 2 and (3) of FIG. 3. Accordingly, a consequent writing-in voltage $2V_W$ appears in the wave form of V(xy) as illustrated in (4) of FIG. 3 during the period t13 to t14.

In the plasma display panel 1 illustrated in FIG. 1, a current of approximately 100 $\mu$A passes through a discharge occurring in a spot formed by the cross point of the electrodes. Since currents of the discharge formed in spots formed by cross points of the electrodes are supplied from the same power source, a fluctuation of the discharge sustaining voltage between the electrodes occurs if the number of the discharging spots is large because a large current must be derived from the power source. Such a fluctuation of the discharge sustaining voltage between the electrodes makes writing-in and erasing of information of a plasma display panel difficult.

The relationship between the discharge sustaining voltage and the number of discharging spots in a prior art plasma display panel is illustrated in FIG. 4. In FIG. 4, the abscissa represents the ratio Rd in percentage of the number of discharging spots to the number of the entire spots, and the ordinate represents the discharge sustaining voltage. No discharge is maintained in the region below the lower limit curve L running from p4 through p6. Excessive discharges occur in the region over the upper limit curve U running from p1 through p3. Accordingly, an appropriate discharge occurs only in the range between the curves L and U. In the prior art plasma display panel, the discharge sustaining voltage V(q2) is selected as the mean value of V(p1) and V(p4). This voltage V(q2) is constant in the range of 0% through 100% of Rd. Accordingly, the width $\overline{p1q4}$ of the margin $M_0$ has to be limited below a predetermined value. Sometimes it happens that no margin is obtained in the characteristic illustrated in FIG. 4. Therefore, such a characteristic as illustrated in FIG. 4 is disadvantageous for the operation of a plasma display panel.

A prior art plasma display panel providing a circuit for controlling the discharge sustaining voltage is disclosed in, for example, Japanese Patent Application Laid-open Publication No. 50-62538.

SUMMARY OF THE INVENTION

The present invention has been proposed to eliminate the above described disadvantage of the prior art plasma display panel.

It is the principal object of the present invention to enlarge the width of the margin of the discharge sustaining voltage, to prevent the reduction of the brightness of a discharging spot, and to ensure stable discharges in a plasma display panel.

In accordance with the present invention, a system for driving a plasma display panel device comprises a plasma display panel having dischargeable spots formed by cross points between X-direction electrodes and Y-direction electrodes, a drive circuit for supplying discharge sustaining voltages and information writing-in voltages to said X-directional and Y-directional electrodes and a power source for supplying power to said drive circuit, said discharge sustaining voltage being varied in accordance with the value of the discharge current through discharging spots, characterized in that said system further comprises means for dropping the output voltage of said power source, means for detecting the current supplied to said drive circuit and means for short-circuiting said output voltage dropping means, said short-circuiting means being controlled by said current detecting means, whereby predetermined different values of the discharge sustaining voltage are selected corresponding to predetermined different ranges of the ratio of the number of discharging spots to the number of the entire spots of said plasma display panel.

DESCRIPTION OF THE PREFERRED EMBODIMENTS

Figure 5:
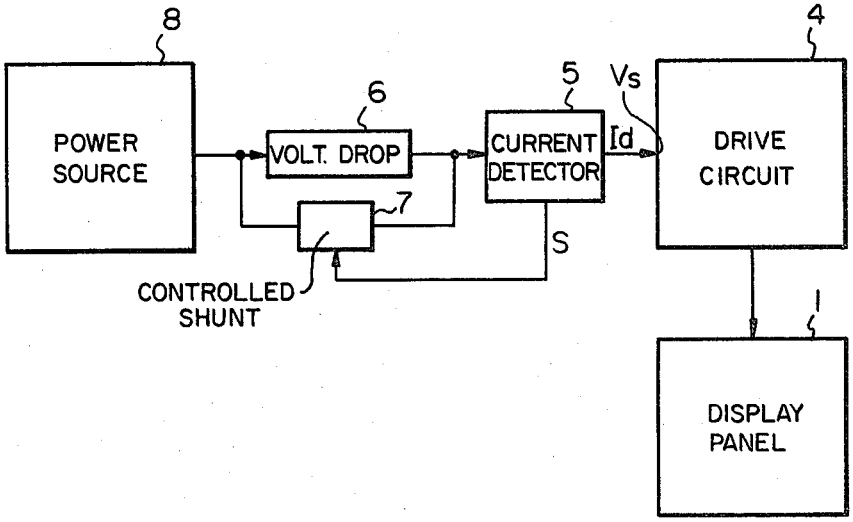
FIG. 5 illustrates a block diagram of a system for driving a plasma display panel in accordance with an embodiment of the present invention.

A system for driving a plasma display panel in accordance with an embodiment of the present invention is illustrated in FIG. 5. A plasma display panel 1 is driven by a drive circuit 4 to which an electric current is supplied from a power source 8 through a voltage dropping element 6 and a current detecting element 5. A short-circuiting element 7, which is controlled by the control output signal S of the current detecting element 5, is connected the voltage dropping element 6. The input voltage of the current detecting element 5 is equal to the output voltage of the power source 8 minus the voltage drop in the voltage dropping element 6.

When the discharge current Id supplied to the drive circuit 4 is increased in accordance with the increase of discharging dots in the plasma display panel 1, such an increase of the discharge current Id is detected by the current detecting element 5 so that a control signal S is supplied to the short-circuiting (controlled shunt) element 7 which causes the voltage dropping element 6 to short-circuit. Thus, the input voltage of the current detecting element 5 and accordingly, the input voltage of the drive circuit 4, is increased due to the omission of the voltage drop in the voltage dropping element 6. Accordingly, the discharge sustaining voltage supplied to the plasma display panel 1 is increased so that a satisfactory margin is obtained in the operational characteristic of the plasma display panel 1.

Figure 7:
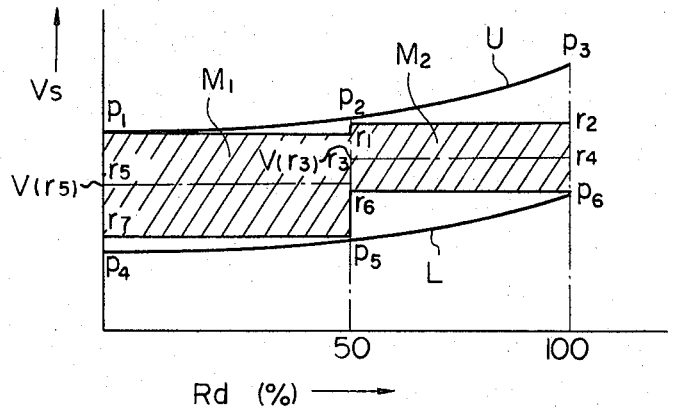

An example of the operational characteristic of the plasma display panel 1 which is driven by the power supplying system of FIG. 5 is illustrated in FIG. 7. In the region where Rd is below 50%, the discharge sustaining voltage is selected as V(r5) due to the voltage drop in the voltage dropping element 6, while in the region where Rd is between 50% and 100%, the discharge sustaining voltage is selected as V(r3) which is higher by the value $\overline{r3\ r5}$ than V(r5). Thus, both the width $\overline{p1\ r7}$ of the margin $M_1$ and the width $\overline{r2\ p6}$ of the margin $M_2$ are considerably large, and accordingly, a large portion of the region between the lower limit curve L and the upper limit curve U is available for the margins $M_1$ and $M_2$. Accordingly, the operational characteristic of the plasma display panel, is improved.

Figure 1:
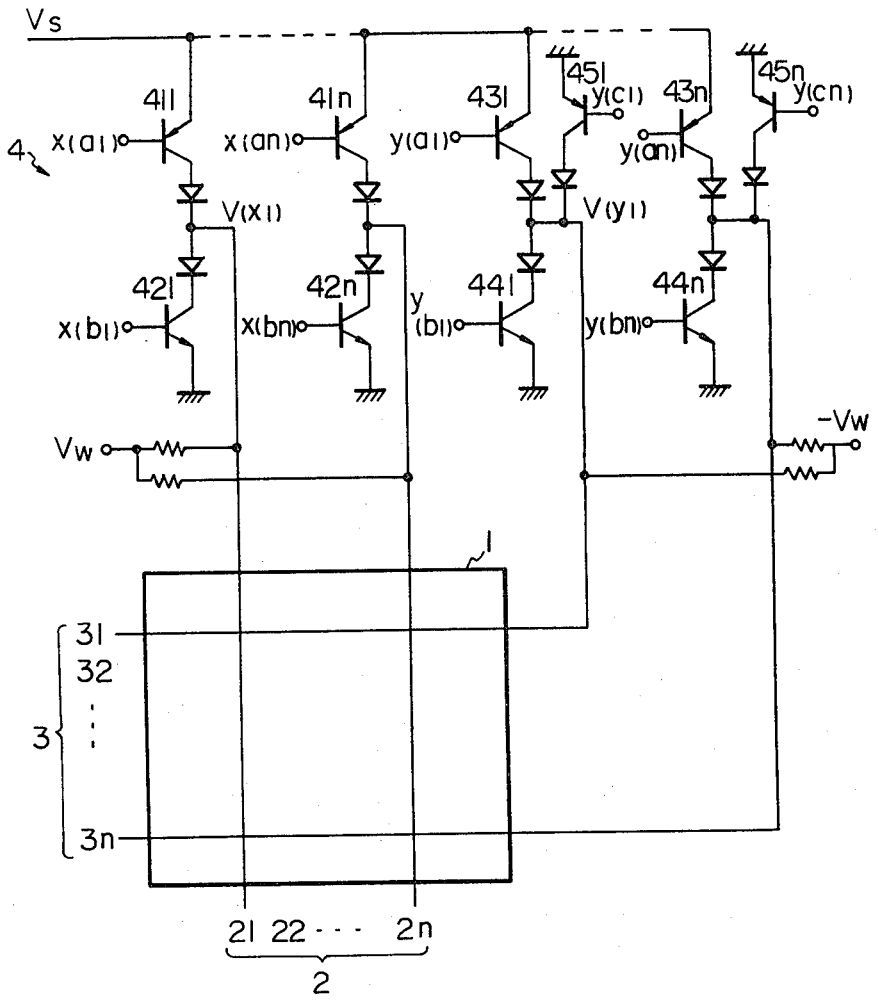
Fig. 1 (PRIOR ART)
FIG. 1 illustrates a circuit diagram of a prior art driving circuit of a plasma display panel, FIGS. 2 (1) to (7) and FIGS. 3 (1) to (5) illustrate a time chart of the operation of the circuit of FIG. 1.
Figure 2:
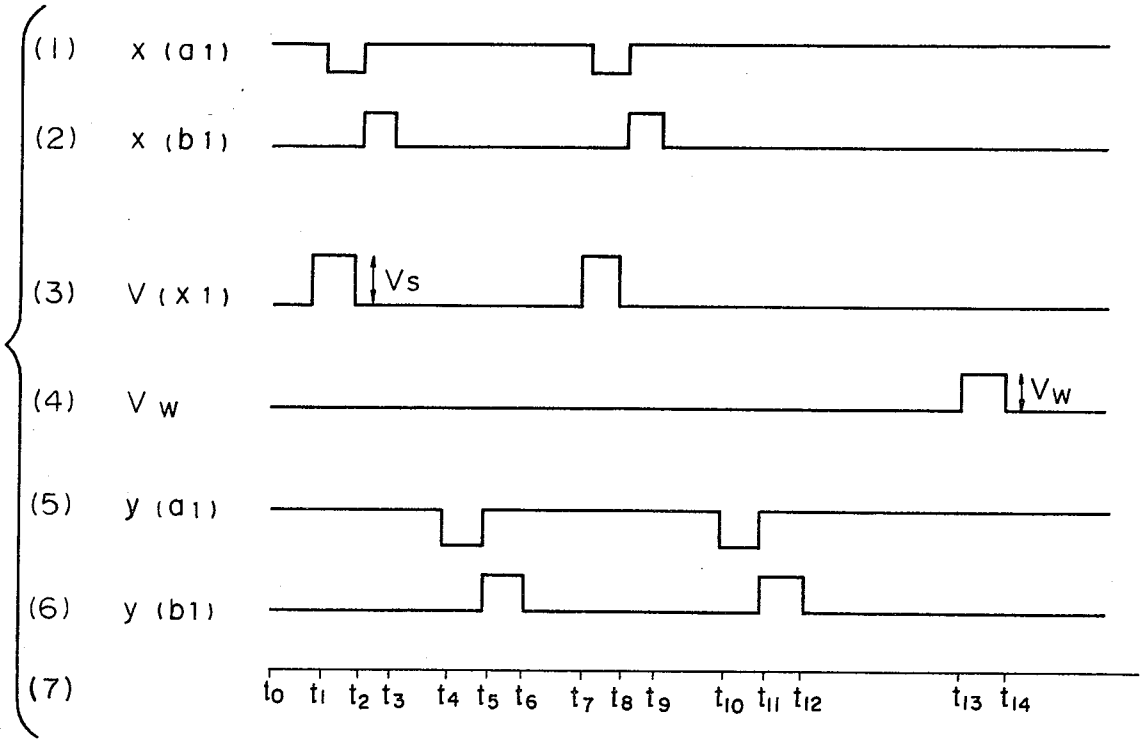
FIG. 2 (PRIOR ART)
Figure 3:
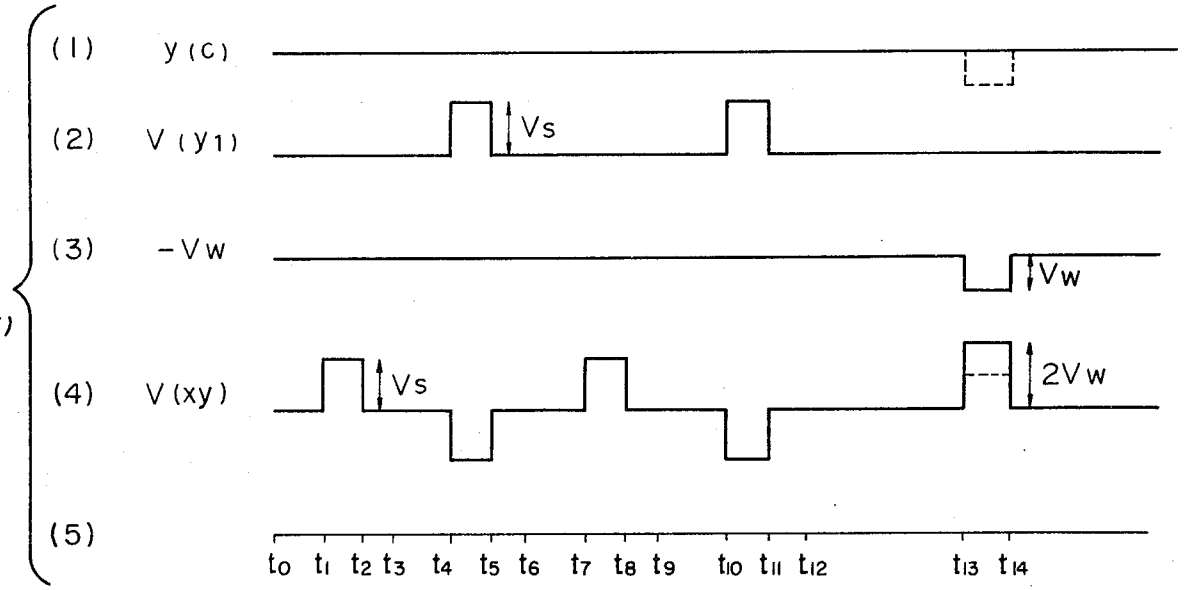
FIG. 3 (PRIOR ART)
Figure 4:
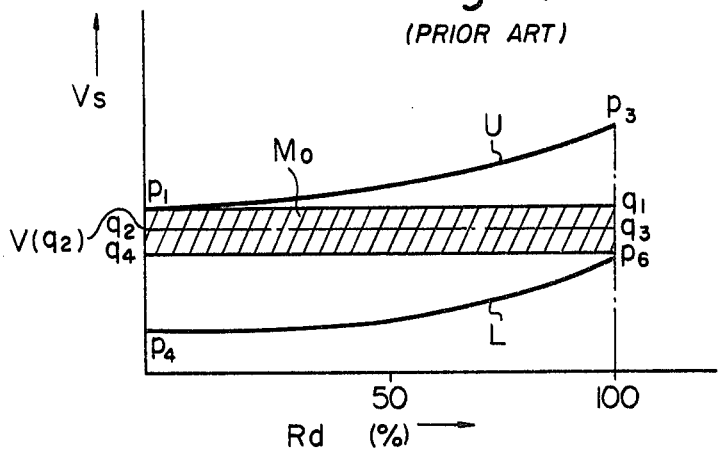
Fig. 4 (PRIOR ART)
FIG. 4 illustrates the relationship between the discharge sustaining voltage and the number of discharging spots in the device of FIG. 1.

The inventor of the present invention confirmed the following facts as a result of his experiments. That is, when the number of entire spots was 200,000 and the discharge sustaining voltage V(r5) was 95 volts, the width $\overline{p1\ r7}$ of the margin $M_1$ was approximately 8 volts and the width $\overline{r2\ p6}$ of the margin $M_2$ was approximately 6 volts. It should be noted that, in the prior art characteristic illustrated in FIG. 4, the width $\overline{p1\ q4}$ of the margin $M_0$ was only approximately 3 volts.

Figure 6:
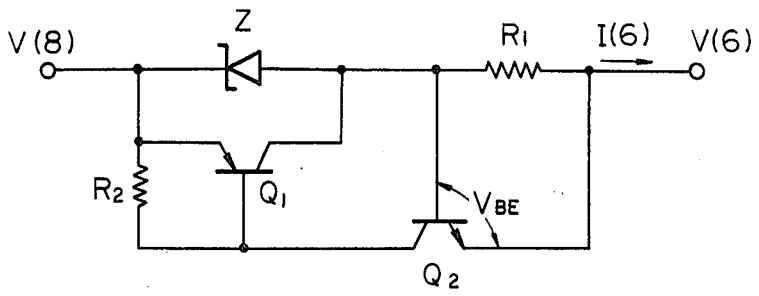
FIG. 6 illustrates an example of a circuit used in the system of FIG. 5 and, FIG. 7 illustrates the relationship between the discharge sustaining voltage and the number of discharging spots in the system of FIG. 5.

An example of the circuit of the current detecting element 5, the voltage dropping element 6 and the short-circuiting element 7 is illustrated in FIG. 6. In FIG. 6, a resistor $R_1$ corresponds to the current detecting element, a Zener diode Z corresponds to the voltage dropping element, and the transistors $Q_1$ and $Q_2$ correspond to the short-circuiting element.

When the output current I(6) is small, the transistors $Q_2$ and $Q_1$ are in an "OFF" state, and accordingly, the output voltage V(6) equals the input voltage V(8) minus the voltage drops in the Zener diode Z and the resistor $R_1$. If the output current I(6) is increased because of an increase in the discharging dots in the plasma display panel, the transistor $Q_2$ is turned "ON" due to the increase of the voltage across the resistor $R_1$ and accordingly, the transistor $Q_1$ is turned "ON". Thus, the current passes from the input terminal through the emitter and the collector of the transistor $Q_1$ and the base and the emitter of the transistor $Q_2$ to the output terminal. Accordingly, the voltage drop in the Zener diode is omitted and the drop in the resistor is limited to VBE of the transistor $Q_2$ so that the output voltage V(6) is increased.

Although in the embodiment illustrated in FIGS. 5, 6 and 7 the number of steps of the discharge sustaining voltage is selected as two in accordance with the number of regions of Rd, it is possible to divide the regions of Rd into three or more portions and accordingly, the number of steps of the discharge sustaining voltage is selected as three or more.

Furthermore, although the above described explanations are related to a plasma display panel of the AC type, the present invention is also applicable to a plasma display panel of a non-memorizing DC type which does not have the above mentioned dielectric layer on the X and Y electrodes.

I claim:

1. A system for driving a plasma display panel device, said device having dischargeable spots formed by cross points between X-directional electrodes and Y-directional electrodes, a drive circuit supplying discharge sustaining voltages and information writing-in voltages to said X-directional and Y-directional electrodes and a power source supplying power to said drive circuit, for increasing said discharge sustaining voltage with increasing the value of the discharge current through the discharging spots, said discharge current through the discharging spots corresponding to the current supplied to said drive circuit by said power source, said system comprising;

means for dropping in at least one step the voltage that is applied to said drive circuit from said power source, said dropping means comprising a respective stage for each said step, means for detecting the current supplied to said drive circuit, switching means for controllably shunting each said stage of said dropping means, responsive to the value of said detected current, so that said voltage that is applied to said drive circuit increases in stepwise fashion in correspondence to at least two predetermined different ranges of the ratio of the number of said discharging spots to the number of said dischargeable spots of said plasma display panel.

2. A system for driving a plasma display panel device of DC discharge type, said device having dischargeable spots formed by cross points between X-directional electrodes and Y-directional electrodes, a drive circuit supplying discharge voltages to said X-directional and Y-directional electrodes and a power source supplying power to said drive circuit, for increasing said discharge voltage with increasing the value of the discharge current through the discharging spots, said discharge current through the discharging spots corresponding to the current supplied to said drive circuit by said power source said system comprising;

means for dropping in at least one step the voltage that is applied to said drive circuit from said power source, said dropping means comprising a respective stage for each said step, means for detecting the said current that is supplied to said drive circuit, and means for controllably shunting each said stage of said dropping means, responsive to the value of said detected current, so that said voltage that is applied to the drive circuit increases in stepwise fashion in correspondence to at least two predetermined different ranges of the ratio of the number of said discharging spots to the number of said dischargeable spots of said plasma display panel.

3. The system of claim 1 or 2, said means for detecting the current supplied to said drive circuit comprising a resistor.

4. The system of claim 1 or 2, said switching means being connected in parallel with said dropping means for short-circuiting said output voltage dropping means when said current detecting means detects a respective increase in the current supplied to said drive circuit.

5. The system of claim 1 or 2, said means for dropping the output voltage of said power source comprising a Zener diode.

6. The system of claim 1 or 2 comprising the cathode of a Zener diode connected to said power source, a first resistor connected between the anode of said Zener diode and said drive circuit, a first transistor having its emitter connected to said cathode and its collector connected to said anode of said Zener diode, a second resistor connected between the emitter and the base of the first transistor, and a second transistor having its base connected to said anode, its collector connected to the base of the first transistor, and its emitter connected to said drive circuit.

* * * * *

UNITED STATES PATENT AND TRADEMARK OFFICE

CERTIFICATE OF CORRECTION

PATENT NO. : 4,349,819

DATED : 14 September 1982

INVENTOR(S) : TOSHIAKI TERAKAWA

It is certified that error appears in the above-identified patent and that said Letters Patent is hereby corrected as shown below:

Col. 1, line 22, "21, 22,-, 2n" should be --21, 22,..., 2n--, all in the same boldface type;
line 23, "31, 32,-, 2n" should be --32, 32,..., 2n--, all in the same boldface type;
line 29, "22,-, 2n" should be --21, 22,..., 2n--;
"31, 32,-, 3n" should be --31, 32,..., 3n--, all in the same boldface type.

Signed and Sealed this

First Day of February 1983

[SEAL]

*Attest:*

GERALD J. MOSSINGHOFF

*Attesting Officer*

*Commissioner of Patents and Trademarks*